United States Patent [19]

Otani et al.

[11] Patent Number: 4,963,110

[45] Date of Patent: Oct. 16, 1990

[54] EXHAUST SYSTEM FOR MARINE PROPULSION

[75] Inventors: Hiroaki Otani; Naoto Matsumoto, both of Hamamatsu, Japan

[73] Assignee: Sanshin Kogyo Kabushiki Kaisha, Hamamatsu, Japan

[21] Appl. No.: 257,708

[22] Filed: Nov. 14, 1988

[30] Foreign Application Priority Data

Oct. 16, 1987 [JP] Japan ..... 62-261443

[51] Int. Cl.[5] ..... B63H 21/32

[52] U.S. Cl. ..... 440/89; 440/77; 440/88

[58] Field of Search ..... 440/89, 77, 88; 181/233, 235, 240

[56] References Cited

U.S. PATENT DOCUMENTS 3,045,423 7/1962 Hulsebus ..... 181/235
3,552,121 1/1971 Kitagawa et al. ..... 440/89
3,967,446 7/1976 Harralson et al. ..... 440/89
4,607,723 8/1986 Okazaki ..... 181/235

*Primary Examiner*—Sherman Basinger
*Assistant Examiner*—Thomas J. Brahan
*Attorney, Agent, or Firm*—Ernest A. Beutler

[57] ABSTRACT

A number of embodiments of outboard motors including external expansion chambers for the exhaust system that are contained within the powerhead externally of the engine and internally of its protective cowling. In some embodiments exhaust gases are delivered to this external expansion chamber through a flexible conduit and in others through internal passages of the engine and outboard motor construction. In some embodiments the exhaust gases are discharged from the external expansion chamber to the atmosphere through an above the water exhaust gas discharge and in other embodiments the external expansion chamber functions only as a Helmholz resonator.

12 Claims, 10 Drawing Sheets

EXHAUST SYSTEM FOR MARINE PROPULSION

BACKGROUND OF THE INVENTION

This invention relates to an exhaust system for a marine propulsion and more particularly to an improved exhaust system for an outboard motor.

As is well known, the compactness of an outboard motor makes it extremely difficult to provide effective silencing for the exhaust gases under all running conditions. That is, unlike many other applications in which internal combustion engines are utilized, it is not possible to provide either the length or number and size of silencing devices in outboard motors in order to achieve the desired silencing. Generally outboard motors include a powerhead and a drive shaft housing with an expansion chamber being formed in the drive shaft housing to which exhaust gases are delivered from the exhaust ports of the engine. In most instances, substantially all of the silencing for the exhaust gases must be done in the drive shaft housing. In some instances, there are provided expansion and silencing devices in a spacer plate that connects the engine to the drive shaft housing. However, these arrangements do not under all circumstances offer the optimum silencing.

It is, therefore, a principal object of this invention to provide an improved exhaust system for a marine propulsion unit.

It is a further object of this invention to provide an improved exhaust system and silencing arrangement for an outboard motor wherein at least a portion of the exhaust silencing system may be positioned within the powerhead of the outboard motor and externally of the engine.

SUMMARY OF THE INVENTION

This invention is adapted to be embodied in an outboard motor that is comprised of a powerhead having an internal combustion engine and surrounding protective cowling. The engine includes an exhaust port for discharging exhaust gases from the engine. A drive shaft housing and lower unit depend from the powerhead and contain propulsion means driven by the engine. An expansion chamber is formed within the drive shaft housing and conduit means formed within the engine and the drive shaft housing convey exhaust gases from the exhaust port to the expansion chamber. An exhaust gas discharge is formed in the lower unit for discharging exhaust gases to the atmosphere from the expansion Chamber. In accordance with this feature of the invention, an external expansion chamber is contained within the powerhead internally of the protective cowling and externally of the engine and conduit means convey exhaust gases from the engine to this external expansion chamber.

DETAILED DESCRIPTION OF THE PREFERRED EMBODIMENTS OF THE INVENTION

Figure 1:
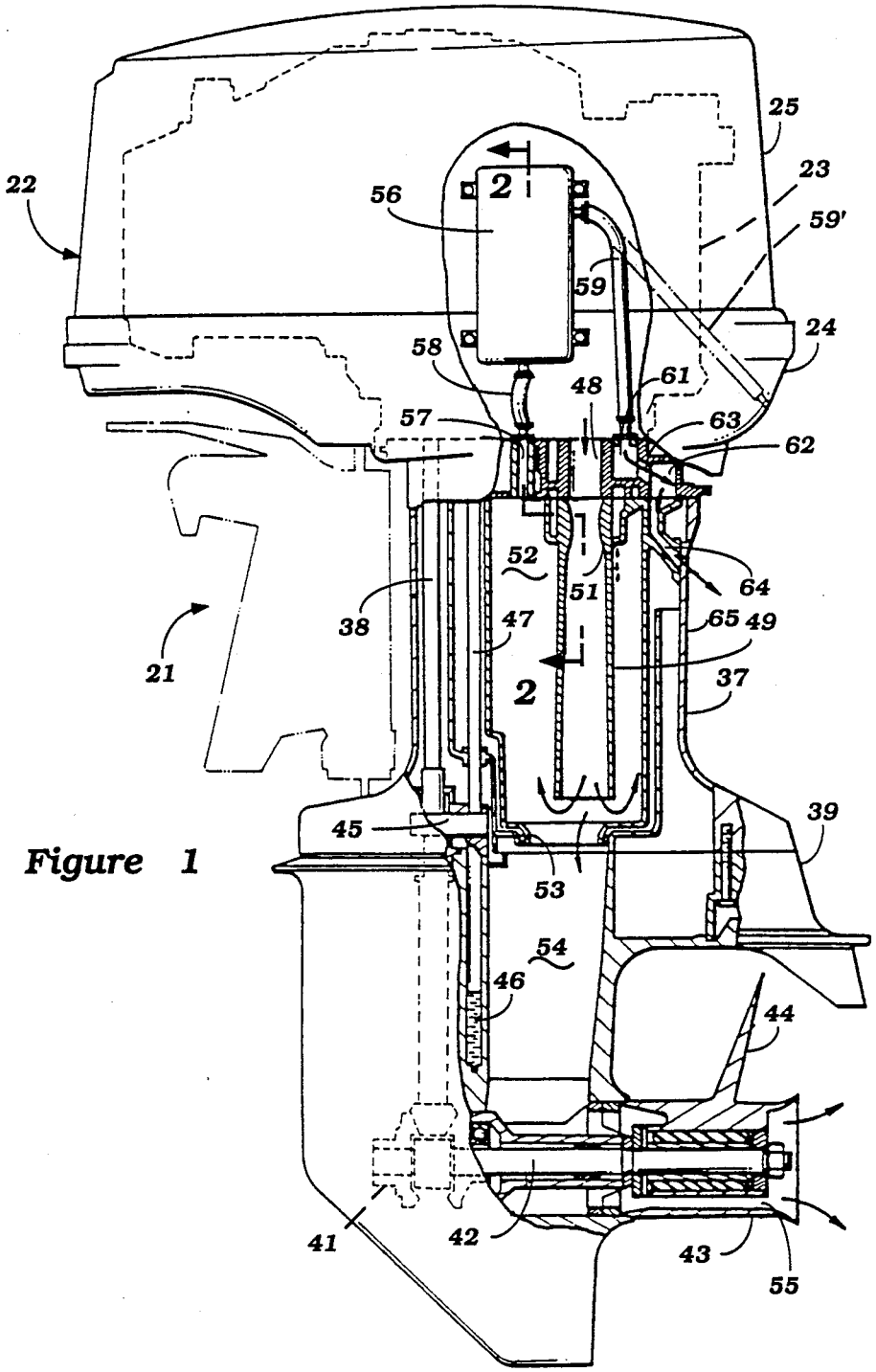
FIG. 1 is a side elevational view of an outboard motor constructed in accordance with a first embodiment of the invention, with portions broken away and other portions shown in section.
Figure 2:
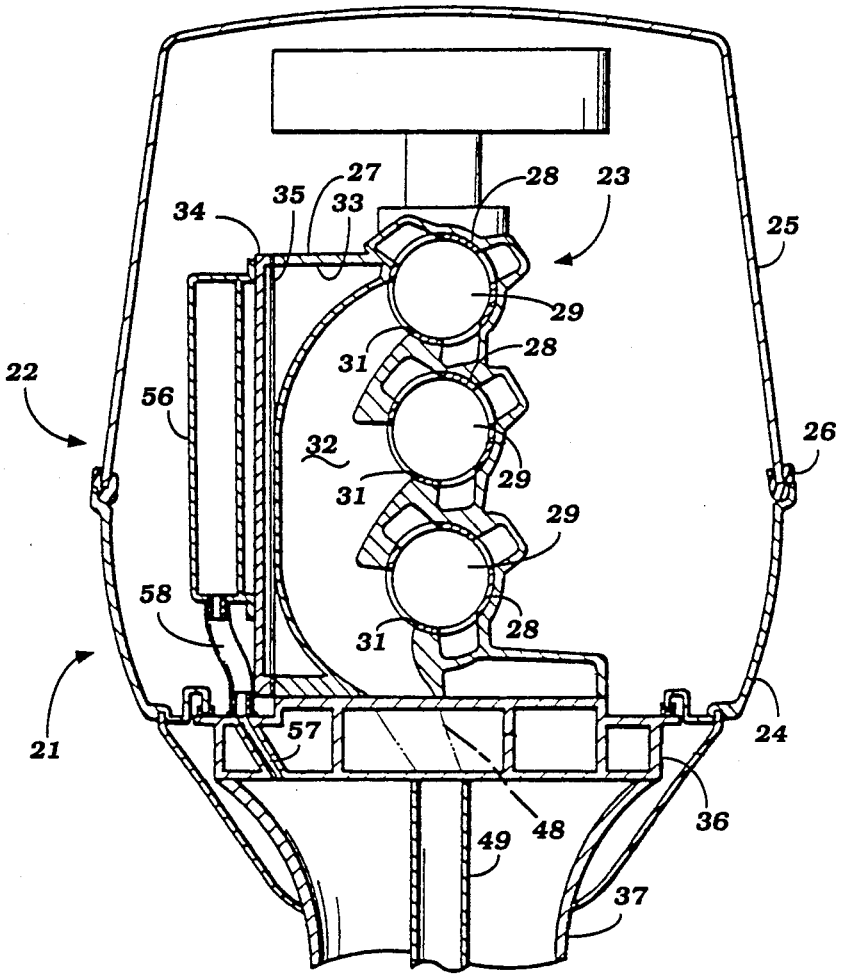
FIG. 2 is an enlarged cross-sectional view taken along the line 2—2 of FIG. 1.
Figure 3:
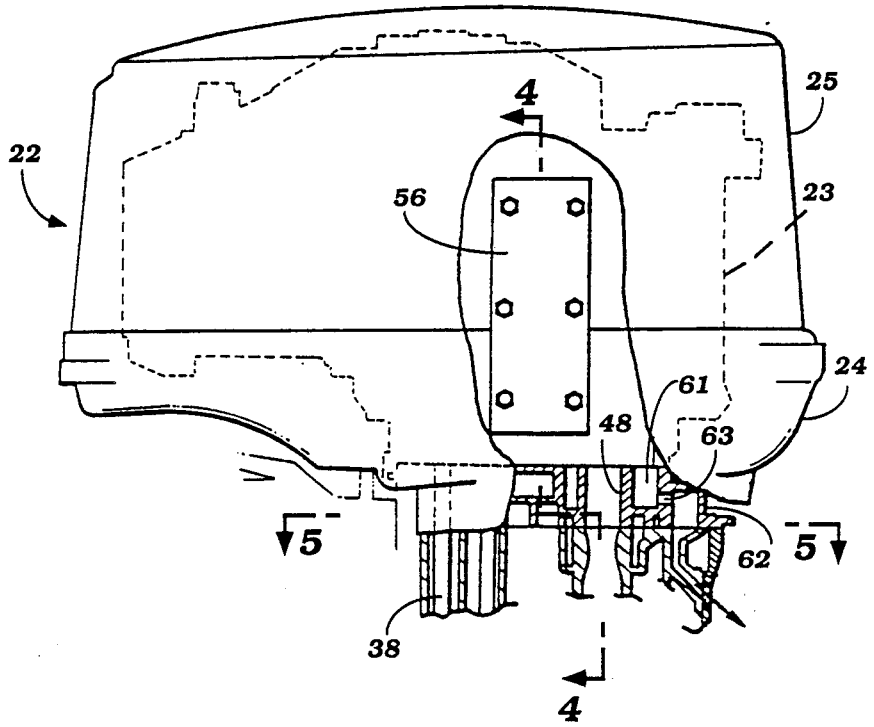
FIG. 3 is a partial side elevational view of an outboard motor constructed in accordance with another embodiment of the invention, with a portion broken away and portions shown in section.
Figure 4:
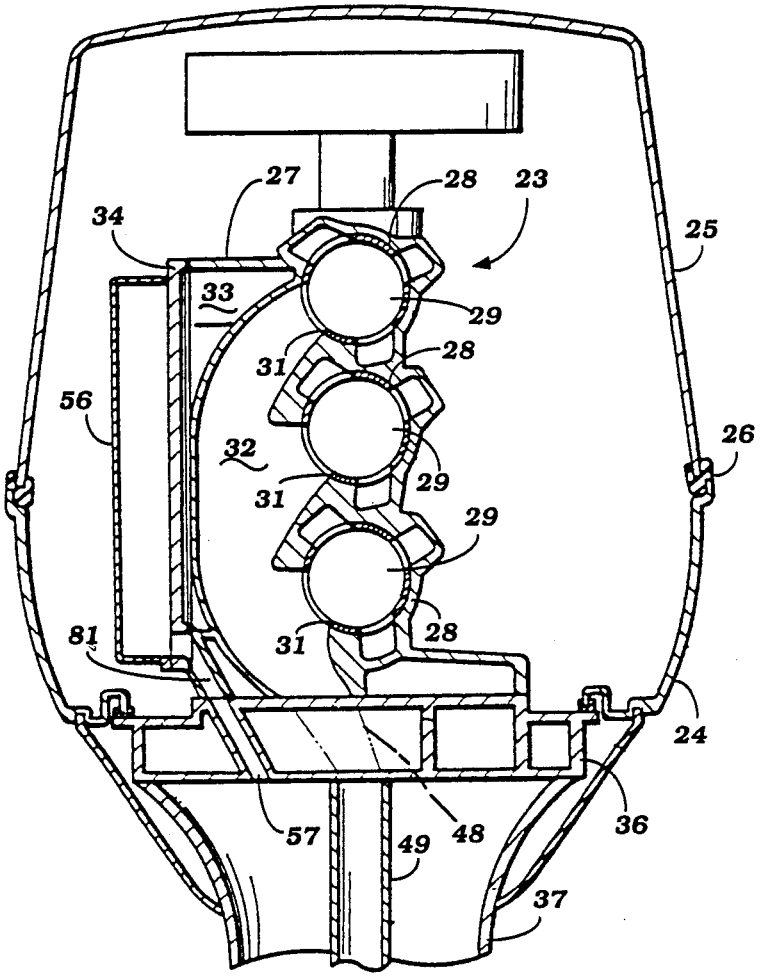
FIG. 4 is an enlarged cross-sectional view taken along the line 4—4 of FIG. 3.
Figure 5:
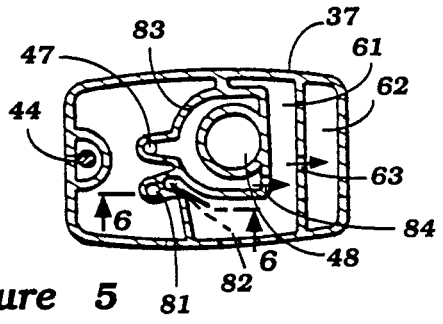
FIG. 5 is a cross-sectional view taken along the line 5—5 of FIG. 3.
Figure 6:
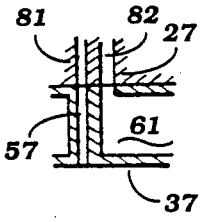
FIG. 6 is a cross-sectional view taken along the line 6—6 of FIG. 5.

Referring first to FIGS. 1 and 2, an outboard motor constructed in accordance with this embodiment of the invention is identified generally by the reference numeral 21. The outboard motor is comprised of a powerhead, indicated generally by the reference numeral 22, which is comprised of an internal combustion engine 23 and protective cowling comprised of a lower tray 24 and removable upper cowling portion 25. A sealing gasket 26 (FIG. 2) is interposed between the tray 24 and cowling portions 25 for sealing purposes.

The engine 23 may be of any known type and is depicted as being of the in-line, three cylinder, two cycle, crankcase compression type that is comprised of a cylinder block 27 having cylinder liners 28 that define cylinder bores in which pistons 29 are supported for reciprocation.

The invention deals primarily with the exhaust system for the engine 23 and, therefore, the specific details of the construction of the internal components of the engine are not believed to be necessary to understand the invention and, for that reason, further description of the basic engine components is not believed to be necessary.

The cylinder liners 28 are provided with exhaust ports 31 which open into an exhaust manifold 32 formed internally of the cylinder block 27. The exhaust manifold 32 is surrounded by a cooling jacket 33 which receives coolant from the engine, and which cools the exhaust manifold 32. The portion of the cooling jacket 33 is closed by a coverplate 34 with an interposed sealing gasket 35.

A spacer plate 36 is interposed between the powerhead 22 and a drive shaft housing 37. The spacer plate 36 supports the engine 23 and also provides a closure for the upper end of the drive shaft housing 37. A drive shaft 38 is driven by the pistons 29 of the engine 23 in a known manner and is rotatably journaled about a vertically extending axis within the drive shaft housing 37.

The drive shaft 38 depends into a lower unit 39 that is positioned beneath the drive shaft housing 37 and which contains a forward, neutral, reverse transmission 41 of a known type for driving a propeller shaft 42. The propeller shaft 42 is suitably journaled within the lower unit 39 and has affixed to it a propeller 43 having blades 44 for powering an associated watercraft.

A water pump 45 is interposed between the drive shaft housing 37 and lower unit 39 and is driven by the drive shaft 38. The water pump 45 draws water from the body of water in which the watercraft is operating through an inlet 46 and delivers it to the cooling jacket of the engine through a conduit 47. As previously noted, this coolant is also delivered to the jacket 33 for cooling the exhaust manifold 32.

The spacer plate 36 is formed with an exhaust passageway 48 that receives exhaust gases that have issued from the exhaust ports 31 and collected in the exhaust manifold 32. An exhaust pipe 49 is affixed to the underside of the spacer plate 36 and has an exhaust passageway that registers with the spacer passageway 48. The exhaust pipe 49 depends into an expansion chamber 52 that is formed within the drive shaft housing 37. Water is delivered to the expansion chamber 52 into proximity with the exhaust pipe 49 from the engine cooling jacket through a restricted orifice 51 for cooling and to assist silencing. The expansion chamber 52 is formed with a restricted outlet neck 53 that mates with an exhaust discharge passageway 54 formed in the lower unit 39. The discharge passageway 54 terminates in an underwater, through the hub, high speed exhaust gas discharge 55. Alternatively, any of the other known types of underwater exhaust gas discharges may be employed for discharging exhaust gases. The combined expansion of the exhaust gases into the expansion chamber 52, subsequent contraction through the passageway 53 and further expansions will aid in silencing of the exhaust gases. Furthermore, the high speed underwater discharge from the through the hub discharge passages 55 will also provide silencing.

The silencing provided by the exhaust system as thus far described may not be fully satisfactory in silencing all of the unwanted noises under high speed running. In addition, when the outboard motor 21 is propelling the watercraft at a low speed, the low speed of the engine 23 and depth of submersion of the outlet 55 will create too much back pressure on the engine. In order to relieve this back pressure, it has been the practice to provide an above the water exhaust gas discharge for low speed running.

In accordance with the invention, there is provided an expansion chamber 56 that is contained externally of the engine 23 but within the protective cowling of the powerhead 22 for providing further silencing and also accommodating the low speed, above the water exhaust gas discharge. The expansion chamber 56 is mounted in proximity to the engine cooling jacket 33 so as to provide cooling for the exhaust gases in the expansion chamber 56. By locating the expansion chamber 56 in the powerhead 22 rather than in the drive shaft housing 37 or in the spacer plate 36 as is conventional, it is possible to use a much larger expansion chamber and, as will become apparent, to even divide this expansion chamber into several chambers. The expansion chamber 56 communicates with the expansion chamber 52 through a passage 57 formed in the spacer plate 36 and a flexible conduit 58 that interconnects this passageway with the expansion chamber 56.

The expansion chamber 56 further is in communication with a second flexible conduit 59 that extends from the upper end of the expansion chamber 56 to a further expansion chamber 61 formed in the spacer plate 36. The expansion chamber 61 communicates with a second expansion chamber 62 formed in the spacer plate through a restricted passageway 63. The expansion chamber 62, in turn, communicates with the atmosphere through a conduit 64 formed in the drive shaft housing 37 and an above the water exhaust gas discharge 65.

As has been previously noted, under high speed running, the propeller discharge 55 will be relatively shallowly submerged and the exhaust gases will all flow out of this discharge. Under this condition, the restriction of the combined conduits 58, 59 and 63 and 64 will prevent any significant exhaust gas flow through the above the water exhaust gas discharge 65. Thus, at high speeds, the expansion chamber 56 will act Helmholz resonator to provide silencing for the exhaust gases. However, as the speed decreases and the submersion through the hub discharge 55 increases, the exhaust gases will then be discharged through the expansion chambers 56, 61 and 62 so as to provide good silencing for the above the water exhaust gas discharge. Thus, the device is effective to provide silencing under, all running conditions.

In the embodiment of FIGS. 1 and 2 there were provided further expansion chambers 61 and 62 for slow speed exhaust gas silencing. However, the conduit 59 may discharge directly to the atmosphere through the passageway 59b shown in phantom and thus eliminate the necessity of the further expansion chambers 61 and 62. Of course, the silencing effect of these chambers will be lost in such an arrangement.

In the embodiment thus far described, the expansion chamber 56 mounted in the powerhead 52 receives exhaust gases from the drive shaft housing expansion chamber 52 through a flexible conduit 58 and also discharges exhaust gases to the atmosphere through an above the water exhaust through the flexible conduit 59. The use of flexible conduits for such purpose has the advantage in permitting a wide latitude in the placement of the expansion chamber of the powerhead. However, in some instances it may be desirable to provide an arrangement wherein the exhaust gases are transferred to and from this expansion chamber through internal components and passages of the engine and/or spacer plate and drive shaft housing. FIGS. 3 through 6 show such an embodiment. Basically, the main components of this embodiment are the same as the previously described embodiment and where that is the case, these components have been identified by the same reference numerals and will not be described in detail, except insofar as is necessary to understand the construction and operation of this embodiment.

In this embodiment, the expansion chamber 56 can mounted directly to the closure wall 34 of the engine cooling jacket 33 surrounding the exhaust manifold 52. The expansion chamber includes an integral passage 81 which mates with the spacer passage 57 so as to convey the exhaust gases directly from the expansion chamber 52 of the drive shaft housing 37 to the expansion chamber 56. Thus, as has been noted, no external passages or conduit is required.

The cylinder block 27 has a further passageway 82 that extends through and enters into the expansion chamber 56 through a suitable opening (not shown) so as to receive the exhaust gases. These exhaust gases are transferred then into the expansion chamber 61 of the spacer plate 36 for discharge to the atmosphere in the manner previously described.

Figure 7:
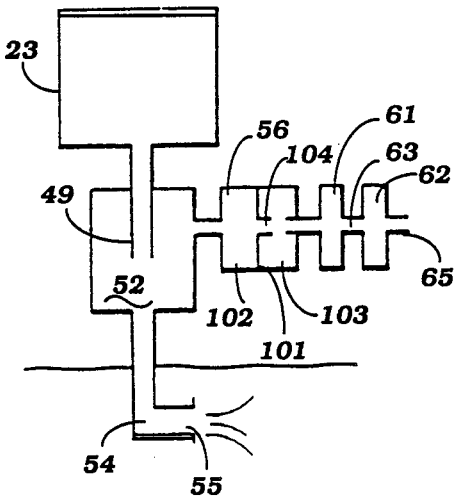
FIG. 7 is a partially schematic view showing the exhaust system of an outboard motor constructed in accordance with a still further embodiment of the invention.

Exhaust cooling and silencing is also achieved by bleeding some engine coolant from a cooling jacket 83 surrounding the exhaust passage 48 into the expansion chamber 61 though a restricted orifice 84. In the embodiments thus far described, the expansion chamber 56 has constituted a single expansion chamber which functions as an expansion chamber under, low speed exhaust conditions and as a Helmholz resonator under high speed exhaust gas conditions. It may also be possible to divide this single expansion chamber into two separate expansion chambers and FIG. 7 shows schematically such an arrangement. In this figure, the major components are the same as those of the embodiments of FIGS. 1 and 2 and of FIGS. 3 through 6. Therefore, only a schematic representation is believed to be necessary in order to understand the construction and operation of this embodiment.

In this embodiment, a baffle plate 101 is contained within the expansion chamber 56 and divides it into two expansion chambers 102 and 103 in a series flow relationship. If desired, the baffle 101 may be provided with a tuning neck 104 so as to further tune the silencing of the exhaust gases. In other regards, this embodiment is the same as those previously noted and in view of that, further description of the construction and operation of this embodiment is believed to unnecessary.

Figure 8:
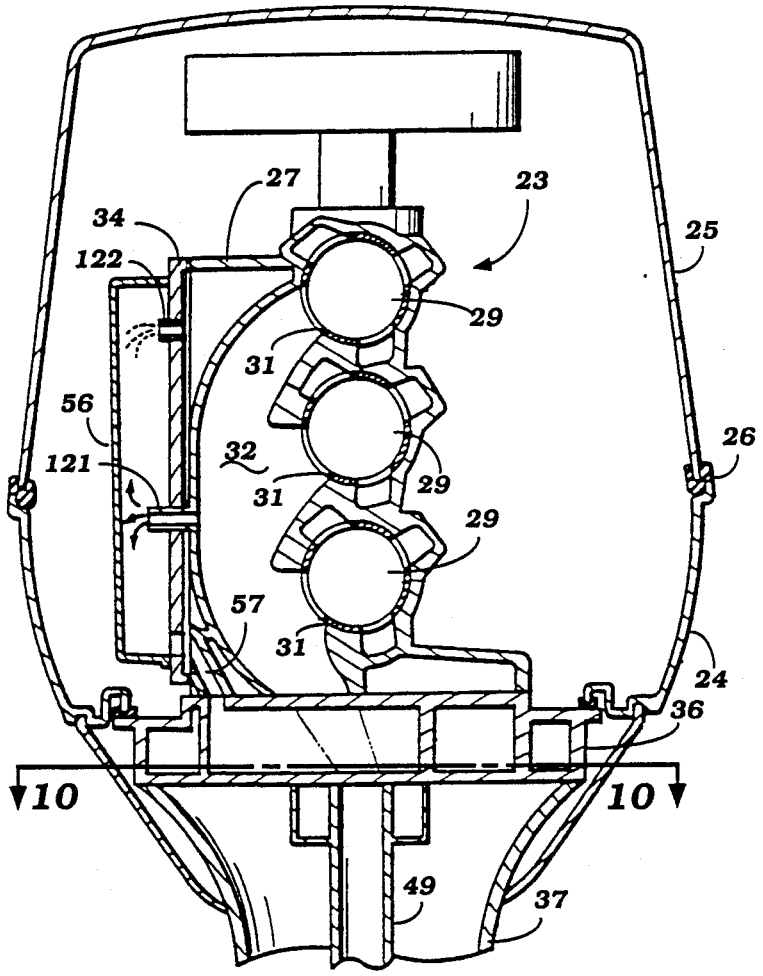
FIG. 8 is a cross-sectional view, in part similar to FIGS. 2 and 4, showing another embodiment of the invention.
Figure 9:
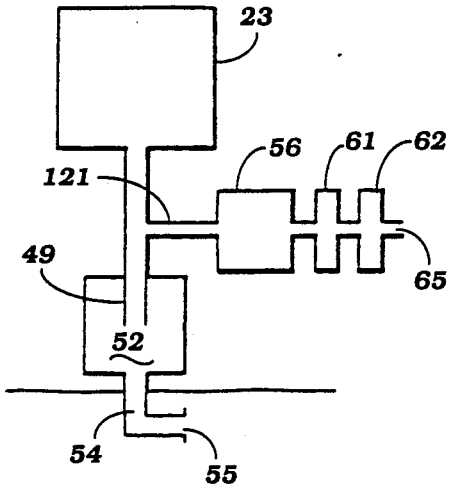
FIG. 9 is a partially schematic view showing the construction of the exhaust system of the embodiment of FIG. 8.
Figure 10:
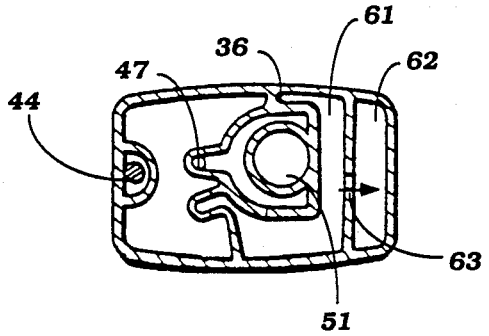
FIG. 10 is a cross-section view taken along the line 10—10 of FIG. 8.

FIGS. 8 through 10 show yet another embodiment of the invention. This embodiment is generally similar to the embodiment of FIGS. 3 through 6. However, in this embodiment the passageways for supplying the exhaust gases to the expansion chamber 56 are simplified and rather than transmitting the exhaust gases from the drive shaft housing expansion chamber 52 to the expansion chamber 56 the exhaust gases are transferred directly from the exhaust manifold 32 to this expansion chamber. This results in a system which is shown schematically in FIG. 9 and in the figures relating to this embodiment those components which are the same as the previously described embodiments have been identified by the same reference numerals and will not be described again, except insofar as may be necessary to understand the construction and operation of this embodiment.

In this embodiment, it will be noted that the exhaust manifold 32 is provided with a nipple section 121 that extends through the coverplate 34 and terminates within the expansion chamber 56 so as to deliver the exhaust gases directly to the expansion chamber 56 without entering into the expansion chamber 52 of the drive shaft housing. As a result, this embodiment operates something like a side branch device under high speed exhaust gas discharge conditions. Under low speed running the exhaust flow is substantially the same as previously described, however, under this circumstance the expansion chamber 52 acts as a side branch device.

In connection with this embodiment, a water nipple 122 may also extend through the coverplate 34 for discharging a metered amount of engine coolant into the expansion chamber 56 to assist in cooling of the exhaust gases. In all other regards, this embodiment is the same as those previously described and for that reason, further description is not believed to be required.

Figure 11:
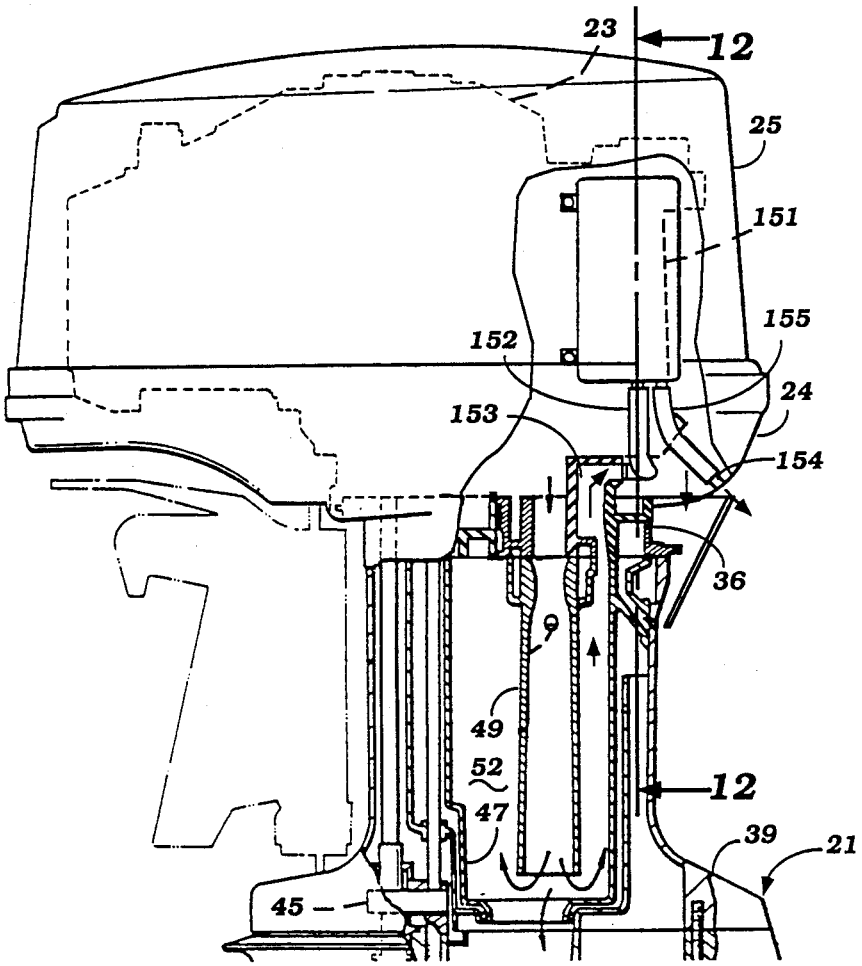
FIG. 11 is a partial side elevational view of an outboard motor constructed in accordance with yet another embodiment of the invention, with portions broken away and other portions shown in section.
Figure 12:
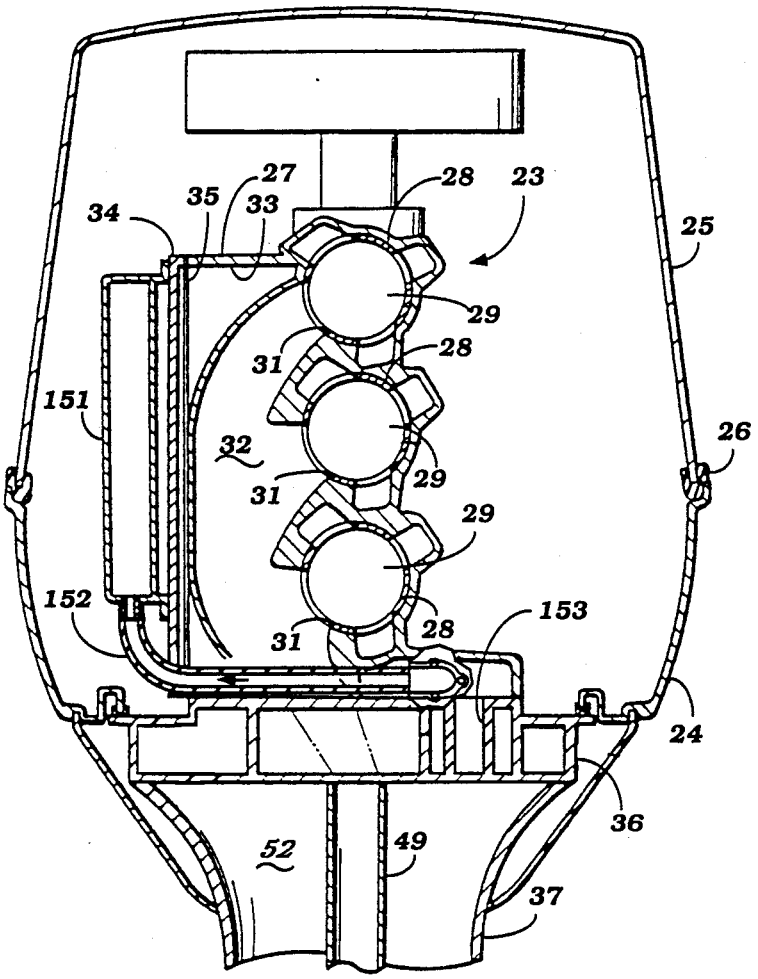
FIG. 12 is a vertical cross-sectional view taken through the embodiment of FIG. 11 generally along the line 12—12.

In the embodiments of the invention as thus far described, the expansion chamber 56 has been mounted on a side of the engine 23 in proximity to the exhaust manifold 32 and cooling jacket 33. However, such a mounting is not required in all instances and FIGS. 11 and 12 show another embodiment of the invention wherein the expansion chamber is mounted at a point spaced from the sides of the engine so that it can have a larger volume accommodated within the protective cowling 25. Except for the location of the expansion chamber and the manner of transmitting exhaust gases to and from it, this embodiment is generally the same as the previously described embodiments. For that reason, components which are the same as the previously described embodiments have been identified by the same reference numerals and will be described again only insofar as is necessary to understand the construction and operation of this embodiment.

In this embodiment, an expansion chamber 151 is mounted at one end of the engine 23 within the protective cowling 25. Exhaust gases are transmitted to the expansion chamber 151 by means of a flexible conduit 152 that communicates with a passageway 153 formed in the spacer plate 36 and which thus delivers the exhaust gases from the expansion chamber 52 of the drive shaft housing 39. These exhaust gases may be discharged directly to the atmosphere through an above the water exhaust gas discharge 154 by means of a flexible conduit 155. Like the embodiment of FIGS. 1 and 2, however, further expansion chambers may be provided for the exhaust gas discharge if desired.

Figure 13:
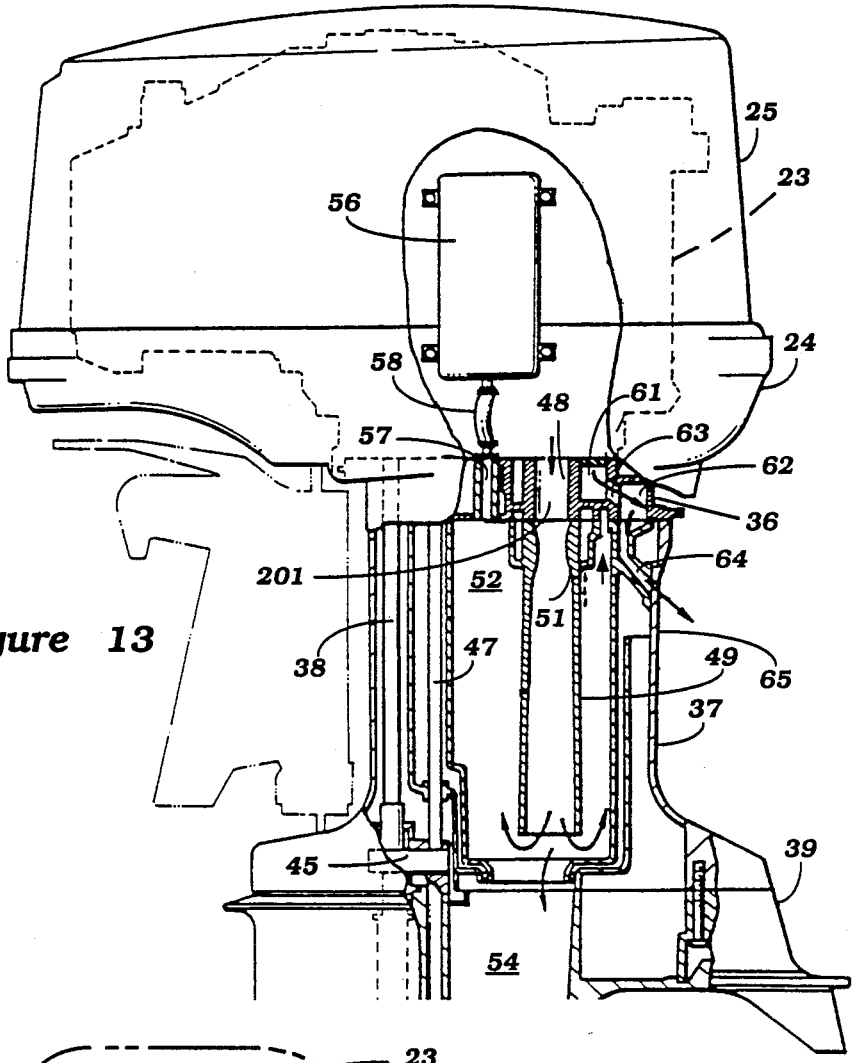
FIG. 13 is a partial side elevational view of an outboard motor constructed in accordance with yet another embodiment of the invention, with portions broken away and other portions shown in section.
Figure 14:
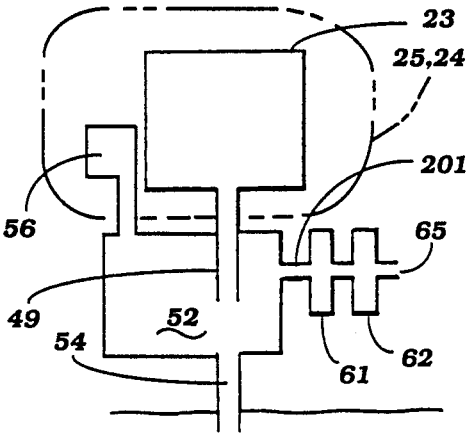
FIG. 14 is a schematic view showing the exhaust system of the embodiment of FIG. 13.

In all of the embodiments of the invention as thus far described, the expansion chamber has functioned as a Helmholz resonator under certain running characteristics and as an expansion chamber when the low speed above the water exhaust gas discharge is discharging the exhaust gases to the atmosphere under low speed running. FIGS. 13 and 14 show another embodiment of the invention wherein the expansion chamber functions only as a Helmholz resonator. Because of the similarity of this embodiment to the embodiments of FIGS. 1 and 2, the components which are the same have been identified by the same reference numerals and will be described again in detail only insofar as is necessary to understand the construction and operation of this embodiment. In this embodiment, it will be noted that the expansion chamber 56 only communicates with the expansion chamber 52 of the drive shaft housing 37 and not with any above the water exhaust gas discharge. As a result, as shown in the schematic view of FIG. 14, the expansion chamber 56 functions only as a Helmholz resonator.

In this embodiment, the exhaust gases are delivered to the expansion chamber 61 in the spacer 36 through an exhaust passageway 201 of the spacer 36 and then to the atmosphere through the successive expansion chamber 62 and above the water discharge 65. As a result, the low speed exhaust gas discharge will be silenced only by the operation of the expansion chambers 52, 61 and 63 although the expansion chamber 56 acting as a Helmholz resonator will provide some degree of silencing even under this running condition.

It should be readily apparent from the foregoing description that a number of embodiments of the invention have been illustrated and described, each of which provides a relatively large expansion chamber within the powerhead of the outboard motor externally of the engine and internally of the protective cowling. Although a number of the embodiments of the invention have been illustrated and described, various changes and modifications may be made without departing from the spirit and scope of the invention, as defined by the appended claims.

We claim:

1. In an outboard motor comprised of a powerhead having an internal combustion engine having an outer periphery, a surrounding protective cowling encircling said outer periphery of said engine and defining a cavity therebetween, said engine having a lower surface through which an exhaust port extends for discharging exhaust gases from said engine, a drive shaft housing and lower unit depending from said powerhead and containing propulsion means driven by said engine, an expansion chamber formed within said drive shaft housing, first conduit means for conveying exhaust gases from said exhaust port to said expansion chamber, and an exhaust gas discharge in said lower unit for discharging exhaust gases to the atmosphere from said expansion chamber, the improvement comprising a separable external expansion chamber contained within said powerhead internally of said protective cowling and externally of said engine outer periphery and above said engine lower surface and detachably supported upon said engine, and second conduit means for conveying exhaust gases from said expansion chamber to said external expansion chamber.

2. In an outboard motor as set forth in claim 1 wherein the second conduit means for conveying the exhaust gases from the engine to the expansion chamber include a flexible second conduit.

3. In an outboard motor as set forth in claim 1 wherein the conduit means for conveying the exhaust gases from the engine to the expansion chamber comprises a passage formed internally in the engine.

4. In an outboard motor as set forth in claim 1 wherein the engine further includes a cooling jacket and the external expansion chamber is in heat exchanging relationship with a portion of the engine cooling jacket for cooling the exhaust gases in the expansion chamber.

5. In an outboard motor as set forth in claim 4 wherein the second conduit means for conveying the exhaust gases to the external expansion chamber include a flexible conduit.

6. In an outboard motor as set forth in claim 4 wherein the conduit means for conveying the exhaust gases from the engine to the expansion chamber comprises a passage formed internally in the engine.

7. In an outboard motor as set forth in claim 1 further including discharge conduit means for discharging the exhaust gases from the external expansion chamber to the atmosphere.

8. In an outboard motor as set forth in claim 7 wherein the discharge conduit means discharges to the atmosphere through an above the water exhaust and other than the exhaust gas discharge in the lower unit.

9. In an outboard motor as set forth in claim 8 further including additional expansion chambers communicating with the discharge conduit.

10. In an outboard motor as set forth in claim 8 wherein the exhaust gases are discharged directly to the atmosphere from the expansion chamber through the powerhead.

11. In an outboard motor as set forth in claim 10 wherein the second conduit means functions as a tuning tube whereby said expansion chamber and said tuning tube function as a Helmholz resonator.

12. In an outboard motor as set forth in claim 1 wherein the second conduit means functions as a tuning tube whereby said expansion chamber and said tuning tube function as a Helmholz resonator.

* * * * *

UNITED STATES PATENT AND TRADEMARK OFFICE

CERTIFICATE OF CORRECTION

PATENT NO. : 4,963,110

DATED : October 16, 1990

INVENTOR(S) : Otani, et al

It is certified that error appears in the above-identified patent and that said Letters Patent is hereby corrected as shown below:

Column 7, line 36, Claim 2, "from the engine to the expansion chamber" should be --to the external expansion chamber--.

Column 7, line 37, Claim 2, delete "second".

Column 7, line 39, Claim 3, after "wherein the" insert --second--.

Column 8, line 13, Claim 6, after "wherein the" insert --second--.

Signed and Sealed this

Ninth Day of March, 1993

*Attest:*

*Attesting Officer*

STEPHEN G. KUNIN

*Acting Commissioner of Patents and Trademarks*